US011813544B2

(12) United States Patent
Flamenco-Pelaez

(10) Patent No.: US 11,813,544 B2
(45) Date of Patent: Nov. 14, 2023

(54) MODULAR TOY STRUCTURE

(71) Applicant: INsite Global Holdings, LLC, Cypress, TX (US)

(72) Inventor: Eduardo Antonio Flamenco-Pelaez, Cypress, TX (US)

(73) Assignee: Insite Global Holdings, Cypress, TX (US)

( * ) Notice: Subject to any disclaimer, the term of this patent is extended or adjusted under 35 U.S.C. 154(b) by 0 days.

(21) Appl. No.: 17/493,512

(22) Filed: Oct. 4, 2021

(65) Prior Publication Data

US 2023/0104009 A1 Apr. 6, 2023

(51) Int. Cl.

| | |
|---|---|
| ***A63H 33/04*** | (2006.01) |
| ***A63H 33/08*** | (2006.01) |
| ***A63H 17/00*** | (2006.01) |
| ***A63H 33/10*** | (2006.01) |

(52) U.S. Cl.

CPC ..... *A63H 33/088* (2013.01); *A63H 17/002* (2013.01); *A63H 33/108* (2013.01)

(58) Field of Classification Search

CPC .... A63H 33/088; A63H 33/10; A63H 33/108; A63H 33/107

See application file for complete search history.

(56) References Cited

U.S. PATENT DOCUMENTS

| | | | | |
|---|---|---|---|---|
| 2,132,647 | A * | 10/1938 | Robins | A63H 33/108 D21/500 |
| 2,426,326 | A * | 8/1947 | Cole | A63H 33/108 29/451 |
| 3,939,600 | A | 2/1976 | Eid | |
| 4,547,160 | A | 10/1985 | Labelle | |
| 5,304,086 | A * | 4/1994 | Bolli | A63H 33/108 446/104 |
| 10,143,931 | B2 * | 12/2018 | Wang | A63H 33/105 |
| 2005/0113177 | A1 * | 5/2005 | Kuo | A63H 33/088 446/97 |
| 2012/0309260 | A1 * | 12/2012 | Coon | A63H 33/108 446/124 |
| 2014/0199677 | A1 * | 7/2014 | Glasband | A63H 33/042 434/365 |
| 2019/0030450 | A1 * | 1/2019 | Huang | G09B 5/02 |
| 2020/0230513 | A1 * | 7/2020 | Chao | A63H 33/107 |

FOREIGN PATENT DOCUMENTS

| | | | |
|---|---|---|---|
| DE | 102013001528 | B3 | 9/2013 |
| FR | 2993472 | A1 | 1/2014 |

OTHER PUBLICATIONS

PCT/US2021/053380, "International Search Report and Written Opinion," dated Jun. 29, 2022, 11 pages.

* cited by examiner

*Primary Examiner* — John A Ricci

(74) *Attorney, Agent, or Firm* — Kilpatrick Townsend & Stockton LLP

(57) ABSTRACT

Components may be used to build a three-dimensional (3-D) model. The components can include supports and connectors. A subset of components can be selected based on the 3-D model. The subset of components can be used to build the 3-D model.

12 Claims, 8 Drawing Sheets

MODULAR TOY STRUCTURE

BACKGROUND

Toys, for example, toy kits which include parts that are assembled to form a 3-dimensional (3-D) object are known. However, many of these toy kits contain parts that can only be assembled into a predetermined 3-D object. Additionally, these toy kits may contain mainly uniform parts which can be more easily produced than parts having varying sizes.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it should be noted that the embodiments may be practiced without the specific details. Furthermore, well-known features may be omitted or simplified in order not to obscure the embodiment being described.

Embodiments and techniques described herein are directed to a system and techniques for assembling 3-dimensional (3-D) objects which may include modular toy structures (e.g., vehicles, structures, animals, robots, and/or any suitable shape and/or structure that can be imagined) as well as the components that can be used to build the 3-D items in accordance with this disclosure. The components can include different components for building the 3-D items. For example, the components can include supports and connectors that can be assembled together to form trusses. The supports and/or the connectors can be different shapes and sizes. For example, the supports can have different widths and/or lengths that can be used to build different modular toy structures (e.g., toy structures with different shapes and/or different sizes). In some examples, multiple 3-D items can be combined to form a larger 3-D item. For example, multiple structures can be combined to form a larger structure.

Turning now to a particular example, in this example, a modular toy structure kit includes supports and connectors. The supports can include openings through which the connectors can be inserted. The connectors can be used to connect the supports to form one or more modular toy structures.

Based on the disclosure and teachings provided herein, the reader should understand that other ways and/or methods may be used to implement the various embodiments. The specification and drawings are, accordingly, to be regarded in an illustrative rather than a restrictive sense. It will, however, be evident that various modifications and changes may be made thereunto without departing from the broader spirit and scope of the disclosure as set forth in the claims.

Figure 1:
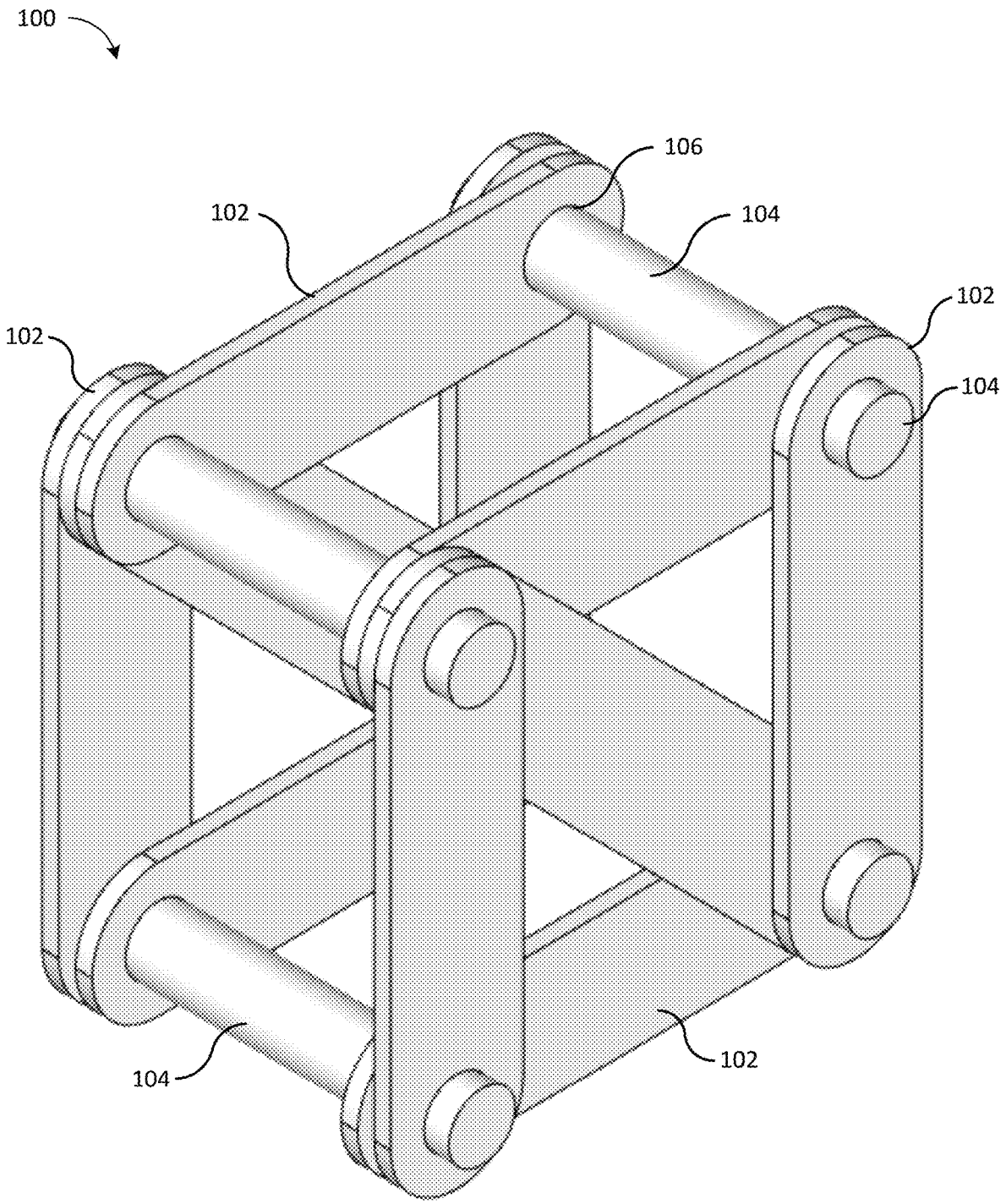
FIG. 1 illustrates an example 3-dimensional (3-D) model, according to at least one embodiment.

Turning now to the figures, FIG. 1 illustrates an example 3-dimensional (3-D) modular toy structure 100. In various embodiments, the modular toy structure 100 can resemble and/or include a truss, a building, an animal, a car, a truck, a tractor, and/or any suitable structure. The modular toy structure 100 can include supports 102 and connectors 104. The supports 102 can be or include plates with one or more connection areas 106 (e.g., engagement areas) for engaging with the connectors 104. In various embodiments, the connection areas can be or include an opening for receiving a portion of the connectors 104. The connectors 104 can be or include cylinders with a circular and/or elliptical cross-section, however, the connectors 104 may have any suitable shape and/or cross-section. The connectors 104 can connect two or more of the supports 102, for example, to form the modular toy structure 100. In various embodiments, multiple supports 102 can be positioned on each end of the connectors 104. For example, the connectors 104 can be inserted through the connection areas of multiple supports 102. In further embodiments, the supports 102 and/or the connectors 104 can be or include wood, plywood, plastic, metal, carbon-fiber, and/or 3-D printed material. In some embodiments, the supports 102 and/or the connectors 104 can include one or more surface finishes. For example, a support 102 and/or a connector 104 can be or include wood and can have a treated surface (e.g., a sealed surface). The surface finish can change the appearance of the support 102 and/or the connector 104 and/or can help the connector 104 more easily be connected with the support 102. For example, the connector 104 can include splines and/or a similar surface feature that can help a user grip the connector 104

In various embodiments, the supports 102 can have the same dimensions (e.g., the same length and/or thickness) as one another. For example, the supports 102 can have the same length. However, the supports 102 may have different dimensions. For example, one or more of the supports 102 may be longer, shorter, wider, or narrower than one or more of the other supports 102. Additionally or alternatively, the connectors 104 can have the same dimensions (e.g., the same length and/or the same cross-section diameter) as one another. However, the connectors 104 can have different dimensions. For example, one or more of the connectors 104 may be longer, shorter, wider, or narrower than one or more of the other connectors 104 and/or one or more of the connectors 104 may have a different cross-section (e.g., a different size and/or shape).

In further embodiments, the supports 102 and/or the connectors 104 can be or include multiple materials. For example, the supports 102 can be or include a first material and the connectors 104 can be or include a second material. Additionally or alternatively, the supports 102 and/or the connectors 104 can each be made of or include multiple types of materials. In some embodiments, the supports 102 and/or the connectors 104 can be one or more colors. For example, the supports 102 can be a first color and the connectors 104 can be a second color. Additionally or alternatively, the supports 102 and/or the connectors 104 can each include multiple colors.

In various embodiments the supports 102 and/or the connectors 104 can be selected to build a pre-determined modular toy structure 100. The supports 102 and/or the connectors 104 can be packed into a kit. For example, as discussed in reference to FIGS. 7 and 8, the kits can include supports 102 and/or connectors 104 and instructions for assembling the supports 102 and/or connectors 104 into one or more modular toy structures 100. In some embodiments, the kits can include supports 102 and/or connectors 104 that can build modular toy structures 100 in the form of one or more of a car, a truss, a building, an animal, and/or any suitable structure.

Figure 2A:
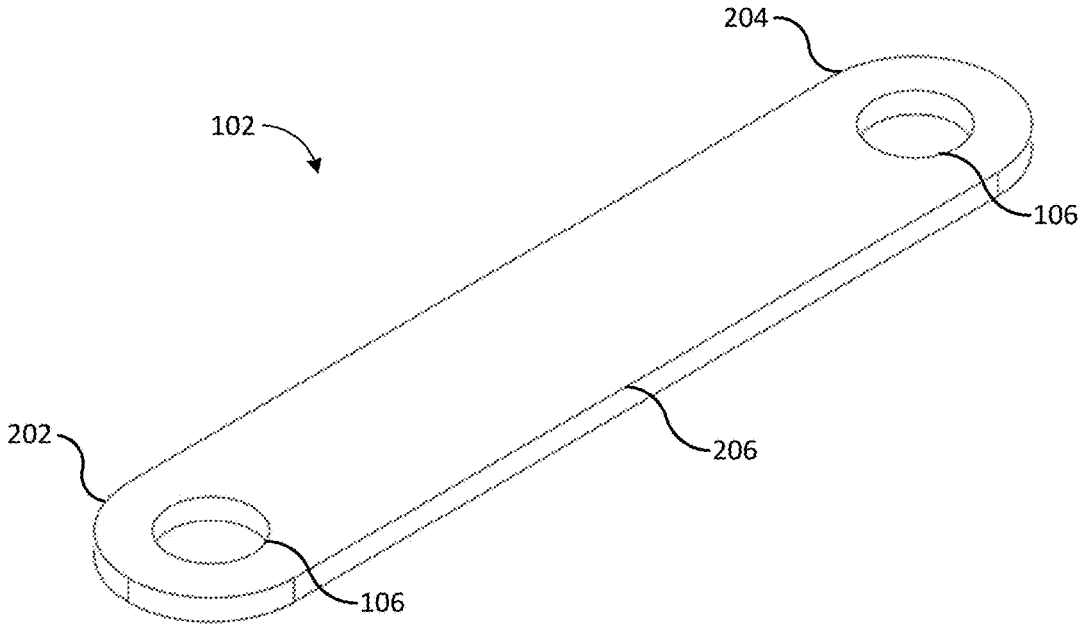
FIGS. 2A through 2C illustrate an example support for use with the example model of FIG. 1, according to at least one embodiment.
Figure 2B:
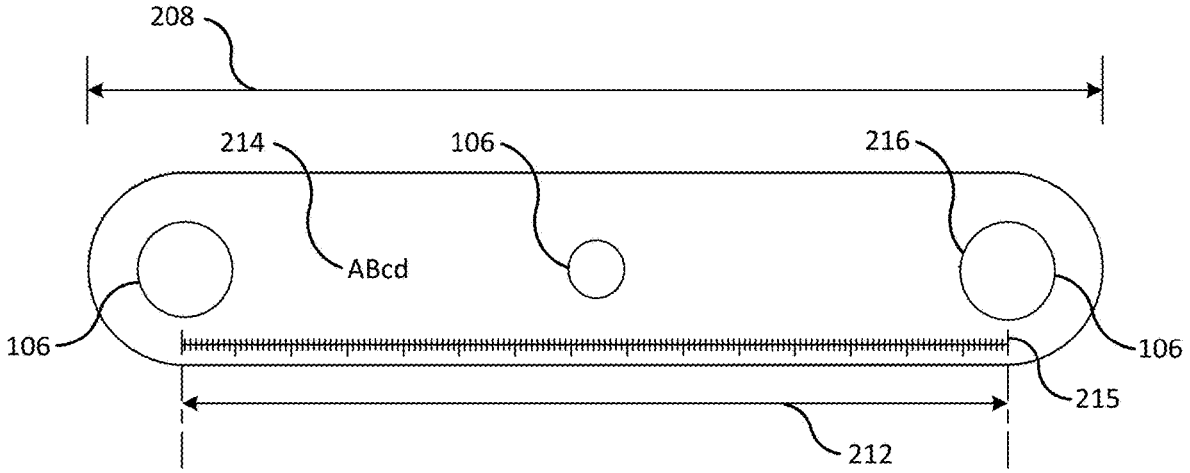
Figure 2C:
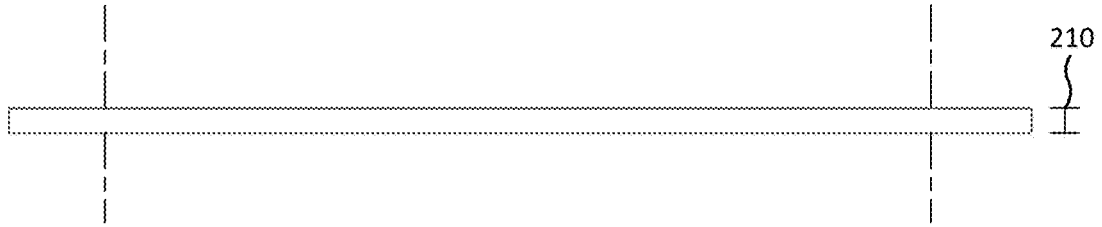

FIGS. 2A through 2C illustrate an example support 102. The example support 102 can include a first end 202, a second end 204, and a central portion 206. The first end 202 and/or the second end 204 can be include one or more connection areas 106. For example, the first end 202 and/or the second end 204 can be or include an opening for receiving a portion of connectors 104. The opening can include a diameter 216. The opening can have a substantially similar area to the cross-section area of the connectors 104. The openings can be the same or similar diameters (e.g., a first opening on the first end 202 can be the same as or similar to a second opening on the second end 204). However, the openings may be different sizes (e.g., a first opening on the first end 202 can be a different diameter than a second opening on the second end 204).

As shown in FIG. 2B, in some embodiments the central portion 206 can be or include one or more connection areas 106. The support 102 can have a length 208 and a width 210. The length 208 can be between 1 inch and 24 inches inclusive (e.g., 1 inch, 2 inches, 3 inches, 5 inches, 10.5 inches, 15 inches, 22 inches, and/or 24 inches). The width 210 can be between 0.1 inches and 6 inches, inclusive (e.g., 0.1 inches, 0.25 inches, 0.5 inches, 1 inch, 3 inches, and/or 6 inches). In some embodiments, the length 208 can be between 1 cm and 100 cm, inclusive (e.g., 1 cm, 5 cm, 10 cm, 25 cm, 50 cm, and/or 100 cm). The width can be between 0.1 cm and 10 cm, inclusive (e.g., 0.1 cm, 0.5 cm, 1 cm, 2.5 cm, 5 cm, and/or 10 cm).

The connection areas 106 can be separated by a distance 212. The distance 212 can be dependent on the length 208. For example, the connection areas 106 can be 1 inch from the end of the supports 102. However, the distance 212 may be independent from the length 208 of the connectors 104. For example, the distance 212 can be 6 inches.

In some embodiments, the support 102 can include markings 214 (e.g., text or a logo). The marking 214 can be positioned on, for example, the central portion 206. However, the marking 214 can be positioned on any suitable area of the support 102. The supports 102 can additionally or alternatively include measurement labels 215. The measurement labels 215 can include markings which equate to different lengths. For example, a first marking can show a millimeter and a second marking can show a centimeter (e.g., 10 millimeters). However, the measurement labels 215 can be any suitable unit of measurement. In various embodiments, the measurement labels 215 can be used to show distances between features of the support 102. For example, the measurement labels 215 can show the distance between the connection areas 106.

In various embodiments, the supports 102 and/or the connectors 104 can be manufactured using a 3-D printer. For example, computer-generated models of the supports 102 and/or the connectors 104 can be generated and sent to a 3-D printer. The 3-D printer can manufacture the supports 102 and/or the connectors 104 based on the computer-generated models. Examples of supports 102 manufactured using a 3-D printer are shown in FIGS. 3A through 4C.

Figure 3A:
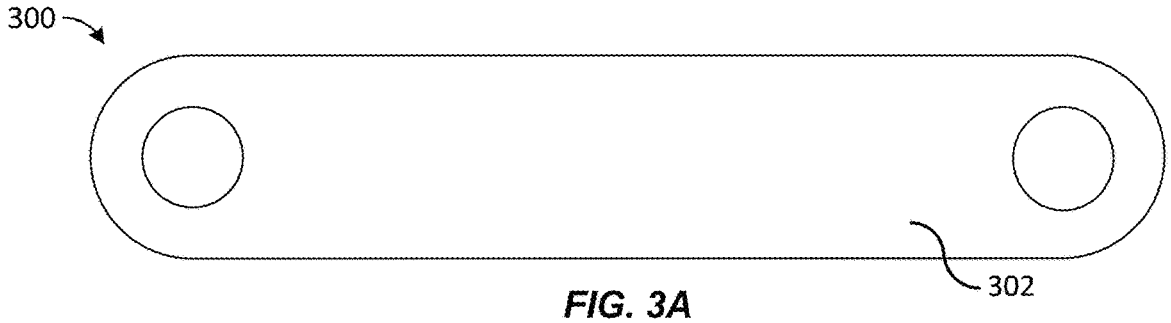
FIG. 3A is a view of a first side of another example support for use with the example model of FIG. 1, according to at least one embodiment.
Figure 3B:
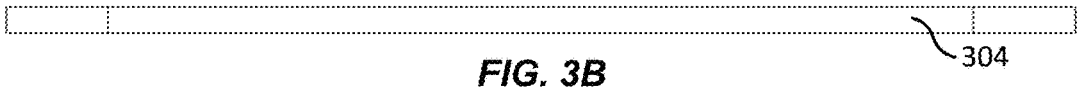
FIG. 3B is a side view of the example support of FIG. 3A, according to at least one embodiment.
Figure 3C:
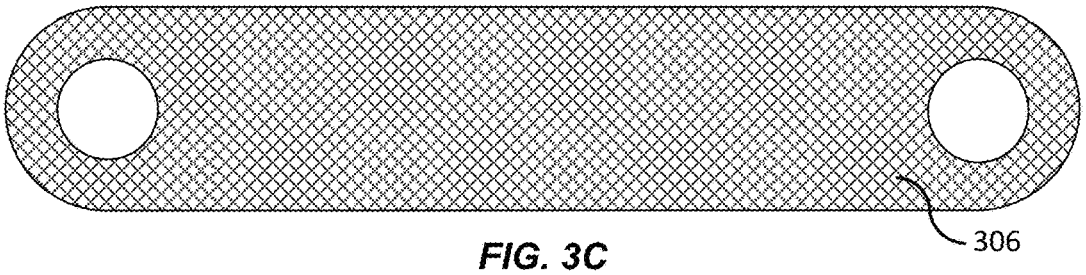
FIG. 3C is a view of a second side of the example support of FIG. 3A, according to at least one embodiment.

FIGS. 3A through 3C show an example support 300 that can be manufactured using a rapid prototyping device, a 3-D printer, and/or a CNC machine, however, the support 300 may be manufactured using any suitable manufacturing method. FIG. 3A shows a top view of the support 300 with a top surface 302. The top surface 302 can be a smooth or semi-smooth surface. For example, the top surface 302 can be a smooth surface that extends across the top of the support 300. FIG. 3B shows a side view of the support 300 with sidewalls 304. The sidewalls 304 can include a smooth or semi-smooth surface. For example, the smooth surface can extend from the sidewalls 304 to the top surface 302. FIG. 3C shows a bottom view of the support 300 with the interior structure 306 of the support 300 exposed. The interior structure 306 can be exposed because the support 300 may not include a bottom surface. For example, the interior structure 306 can be built by the 3-D printer such that it does not need to be encased by surfaces on both sides (e.g., may not need a bottom surface or may not need any surface). The interior structure 306 can provide support to the support 300 and/or may allow the support 300 to be flexible or semi-flexible. For example, the interior structure 306 can allow the support 300 to be more flexible than support 102. The interior structure 306 can be one or more geometric shapes. For example, the interior structure 306 can be or include triangles, squares, hexagons, octagons, and/or any suitable geometric shapes.

Figure 4A:
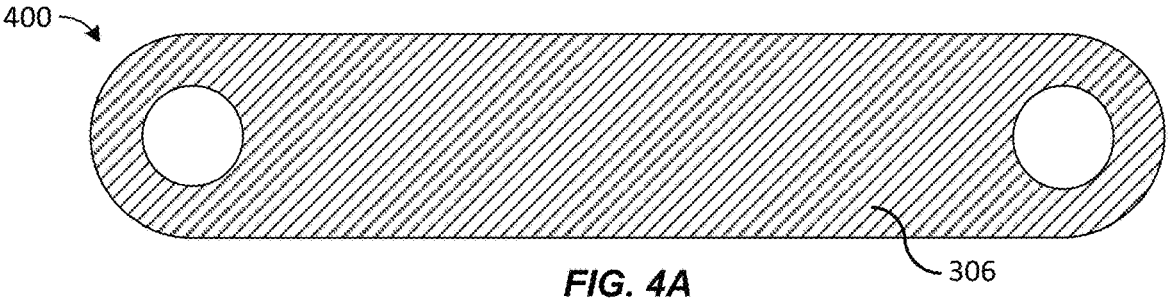
FIG. 4A is a view of a first side of another example support for use with the example model of FIG. 1, according to at least one embodiment.
Figure 4B:
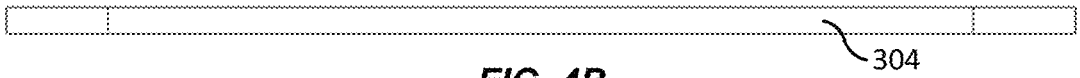
FIG. 4B is a side view of the example support of FIG. 4A, according to at least one embodiment.
Figure 4C:
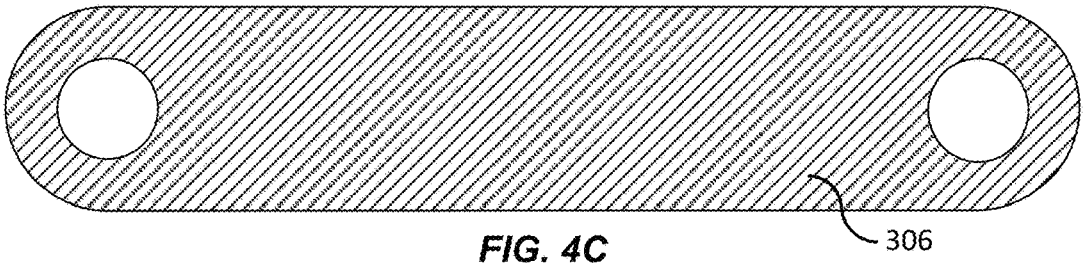
FIG. 4C is a view of a second side of the example support of FIG. 4A, according to at least one embodiment.

FIGS. 4A through 4C show another example support 400 that can be manufactured using a 3-D printer, however, the support 400 may be manufactured using any suitable manufacturing method. The support 400 can be manufactured such that interior structure 306 is exposed on the top and bottom sides (e.g., shown in FIGS. 4A and 4C). The interior structure 306 being exposed on the top and bottom sides can change one or more of the characteristics of the support 400. For example, the support 400 can have greater flexibility than support 300 and/or support 102.

Figure 5A:
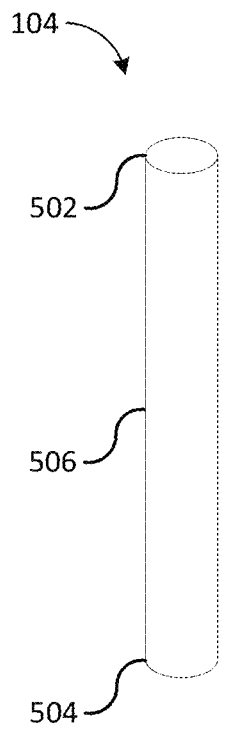
FIGS. 5A through 5C illustrate an example connector such as for use with the example model of FIG. 1, according to at least one embodiment.
Figure 5B:
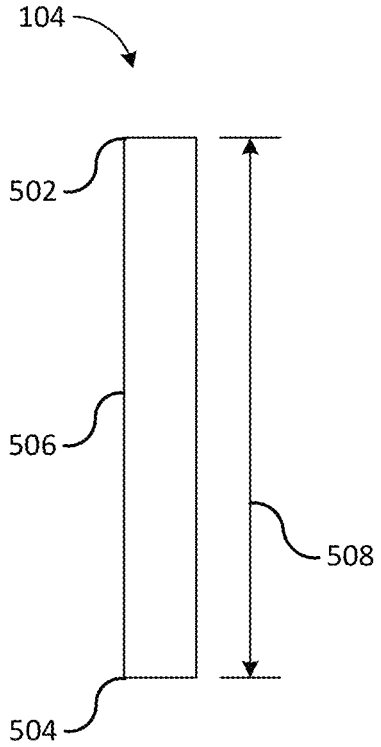
Figure 5C:
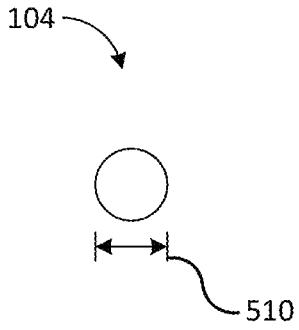

Turning to FIGS. 5A through 5C, an example connector 104 is shown. The connector 104 can be or include a cylinder (e.g., a peg). The connector 104 can include a first end 502, a second end 504, and a central portion 506. A portion of the connectors 104 can be inserted into the support 102 (e.g., when the connection areas 106 include an opening). For example, the first end 502 and/or the second end 504 of the connectors 104 can be inserted into the opening such that the support 102 is positioned on the first or second end 502, 504. However, the connectors 104 can be inserted through the openings such that the support 102 is positioned on the central portion of the connector 104.

The connector 104 can have a length 508. The length 508 can be between 1 inch and 12 inches, inclusive (e.g., 1 inch, 2 inches, 3 inches, 4 inches, 5 inches, 6 inches, 9 inches, and/or 12 inches). In various embodiments, the length 508 can be substantially the same as the width 210 of the support 102. For example, the length 508 can be substantially the same as the width 210 such that the connector 104 can be fully inserted into the opening (e.g. to seal the opening). In further embodiments, the connector 104 can include a lip that can engage with an outer surface of the support 102.

In some embodiments, the connector 104 can have a circular and/or an elliptical cross-section, however, the connector 104 can have a cross-section that is any suitable shape (e.g., square, triangular, hexagonal, octagonal). For example, as shown in FIG. 5C, the connector 104 can have a circular cross-section with a diameter 510. The diameter 510 can be substantially similar to the diameter 216 of the opening of connection areas 106. The diameter 510 can be between 0.1 inches and 2 inches, inclusive (e.g., 0.1 inches, 0.2 inches, 0.5 inches, 0.75 inches, 1 inch, and/or 2 inches).

Figure 6A:
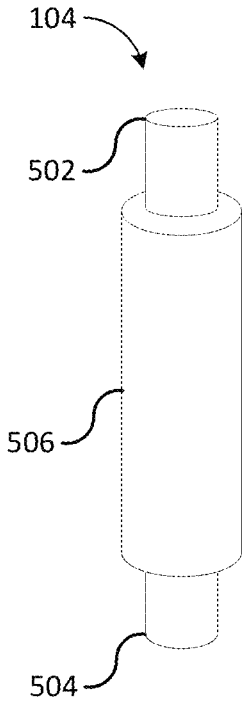
FIGS. 6A through 6C illustrate another example connector such as for use with the example model of FIG. 1, according to at least one embodiment.
Figure 6B:
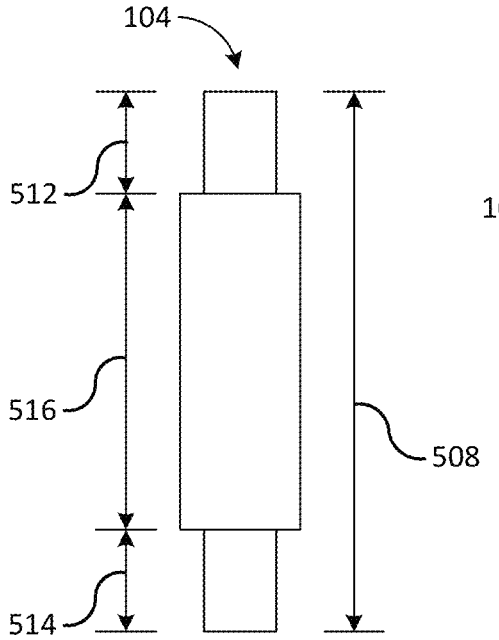
Figure 6C:
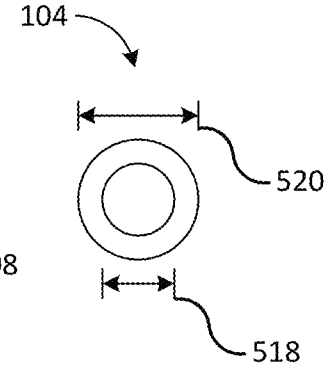

FIGS. 6A through 6C illustrate another example connector 104. The connector 104 can include a first end 502, a second end 504, and a central portion 506. The first end 502 and the second end 504 can have a different shape and/or different dimensions than the central portion 506. For example, the first and second ends 502 can have a shorter length 512, 514, than the length of the central portion 516. Additionally or alternatively, the central portion 506 can have a cross-section with a diameter that is larger than the diameter of the first and/or the second ends 502, 504. The larger diameter of the central portion 506 can allow a user to more easily grip the central portion 506.

Figure 7:
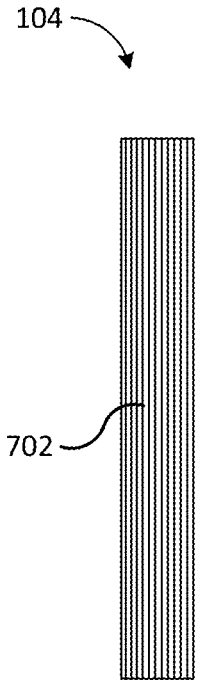
FIG. 7 illustrates another example connector such as for use with the example model of FIG. 1, according to at least one embodiment.

In various embodiments, the connectors 104 can include surface features 702. As shown in FIG. 7, the connectors 104 can include surface features 702. For example, the connectors 104 can include surface features 702 that include splines and/or indentations. The surface features can be indentations in the surface of the connectors 104 and/or protrusions from the surface of the connectors 104. The surface features 702 can aid in connecting the connectors 104 with the supports 102.

Figure 9:
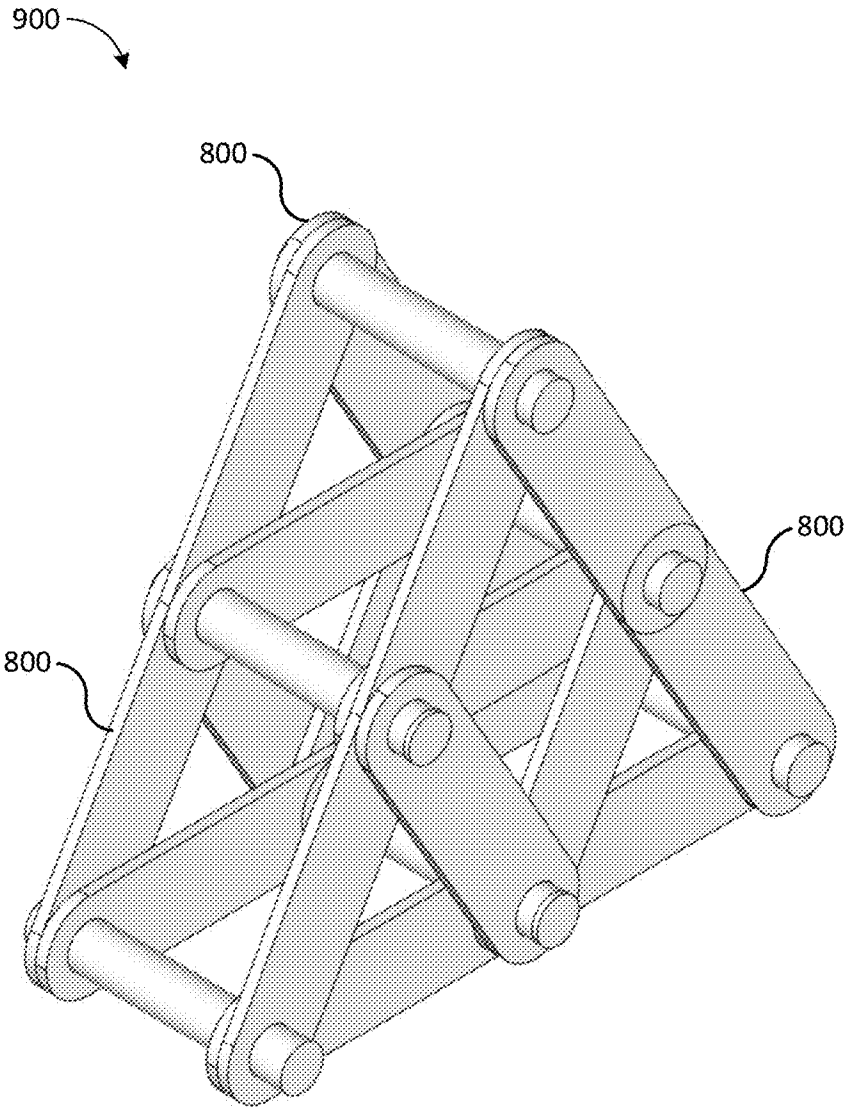
FIG. 9 illustrates another example modular toy structure including the example model of FIG. 5, according to at least one embodiment.
Figure 8:
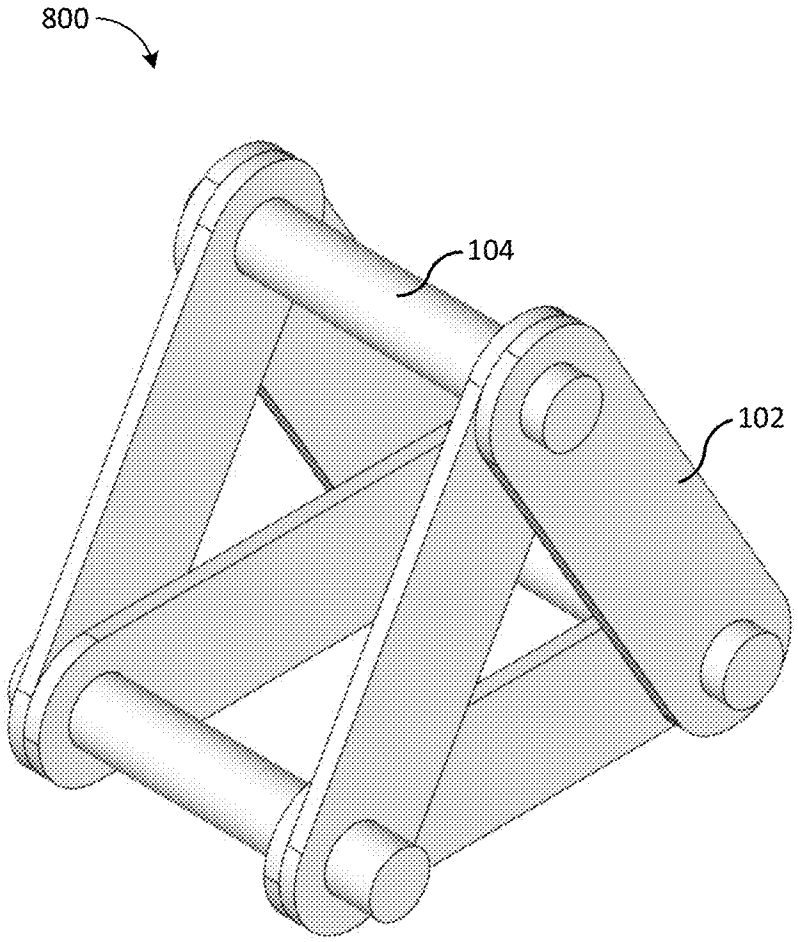
FIG. 8 illustrates another example modular toy structure, according to at least one embodiment.

Turning to FIGS. 8 and 9, example modular toy structures 800 and 900 are shown. FIG. 8 shows a modular toy structure 800 including supports 102 and connectors 104. The connectors 104 connect multiple supports 102 to form the modular toy structure 800. The connectors 104 can receive multiple supports 102 on one end. For example, two supports 102 can be positioned on a first end of the connector 104 and two supports 102 can be positioned on a second end of the connector 104. FIG. 9 shows a modular toy structure 900 that includes multiple modular toy structures 800. For example, three modular toy structure s 800 can be connected together to form a larger modular toy structure 900. It should be appreciated that the materials used for supports 102 and/or connectors 104 may vary, and so the stiffness and/or elasticity of the supports 102 and/or connectors may vary. An interference fit between a support 102 and a connector 104 should keep the two held together, yet easily pulled about by hand, including by a young child.

Figure 10:
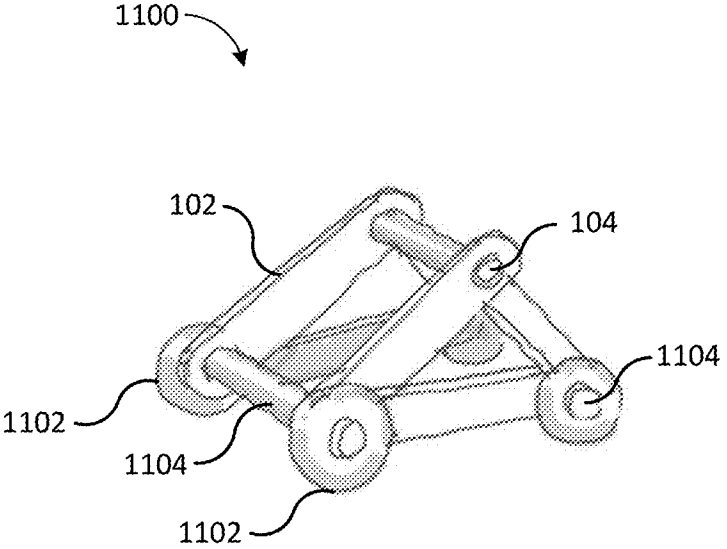
FIG. 10 illustrates another example of a toy structure according to one embodiment.

Turning to FIG. 10 another example modular toy structure 1100 is shown. The modular toy structure 1100 can include supports 102, connectors 104, and wheels 1102. The supports 102 can extend between the connectors 104 to form a structure. The wheels 1102 can be attached to the modular toy structure 1100 to allow the modular toy structure 1100 to move (e.g., roll). The wheels 1102 can be attached to connectors 104 and/or axels 1104. The wheels 1102 can be attached to the connectors 104 and/or axels 1104 such that the wheels 1102 can rotate. The axels 1104 can be or include connectors 104. However, the axels 1104 may include components that allow the wheels 1102 to rotate. For example, the axels 1104 can include bearings.

Figure 11:
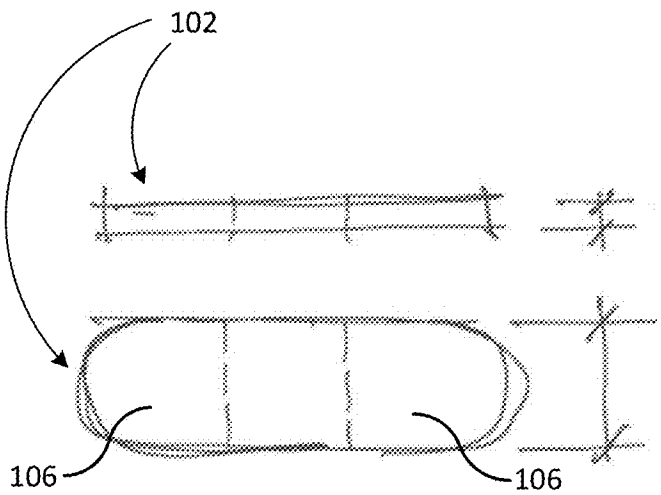
FIG. 11 illustrates another example support for use with the modular toy structure of FIG. 1, according to at least one embodiment.

FIG. 11 is an example of another support 102. The support 102 can include one or more connection areas 106. The connection areas 106 can be or include an area for engaging with the connectors 104. The connection areas 106 can be or include hook and loop connectors, adhesives, hooks, and/or any suitable device for engaging with the connectors 106. In various embodiments, the connection areas 106 can be or include an engagement device that can allow the connectors 104 to rotate.

Figure 13:
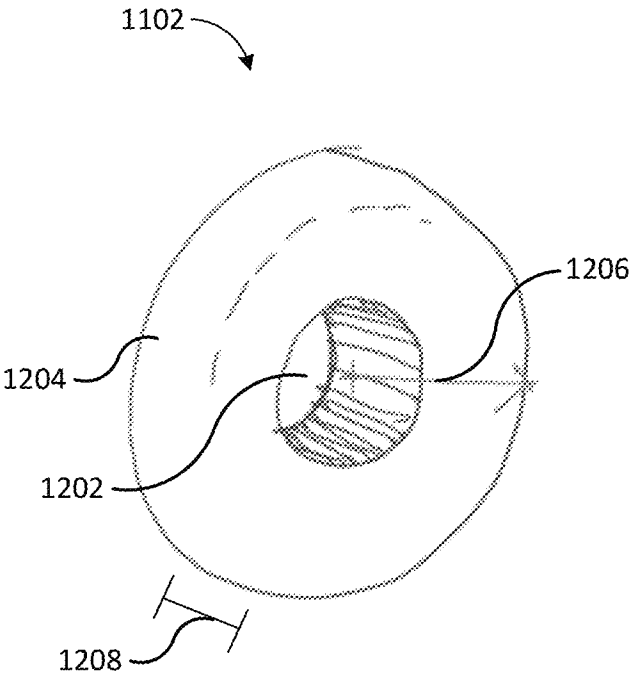
FIG. 13 illustrates another example wheel such as for use with the modular toy structure of FIG. 10, according to at least on embodiment.
Figure 12:
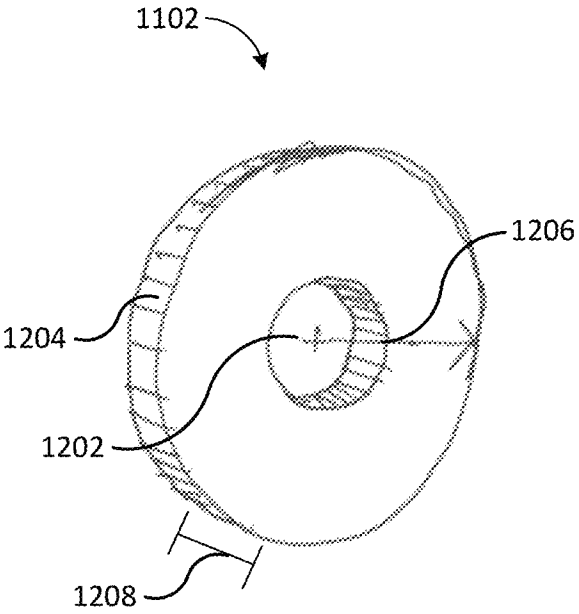
FIG. 12 illustrates an example wheel such as for use with the modular toy structure of FIG. 10, according to at least one embodiment.

FIGS. 12 and 13 are views of alternative wheels 1102 that may be used in one or more embodiments. FIGS. 12 and 13 are additional views of the wheels shown in FIG. 10. FIGS. 12 and 13 show example wheels 1102 that can be used with the modular toy structure 1100. The wheels 1102 can include an opening 1202 and a rolling surface 1204. The opening 1202 can be sized and shaped to receive a portion of the connectors 104 and/or the axels 1104. In various embodiments, the opening 1202 can include components that allow the wheels 1102 to rotate. For example, the opening 1202 can include bearings. The rolling surface 1204 can allow the wheels 1102 to rotate on various surfaces. The rolling surface 1204 can be a relatively "flat" surface (e.g., as shown in FIG. 12) or may be a more rounded surface (e.g., as shown in FIG. 13). For example, the wheel 1102 shown in FIG. 12 is essentially disc-shaped, such as short cylinder with an opening in the middle, while the wheel 1102 shown in FIG. 13 is shaped more as a donut or toroid. The wheels 1102 can be or include wood, plywood, plastic, metal, rubber, silicone, carbon-fiber, and/or 3-D printed material. A kit may be provided with a plurality of wheels 1102 of varying sizes, shapes, colors, and thicknesses, and such wheels 1102 may comprise wheels comprising different or the same materials.

The wheels 1102 can have a radius 1206 that is a different size for different wheels 1102. The radius 1206 can vary such that different sized wheels 1102 can be used with the modular toy structure 1100. For example, the modular toy structure 1100 can include two front wheels 1102 that have a smaller radius 1206 than two back wheels 1102. The opening 1202 can remain the same size (e.g., to receive the connectors 104 and/or the axels 1104) while the radius 1206 of the wheels 1102 changes. For example, a first wheel 1102 with a larger radius 1206 than a second wheel 1102 can have the same size opening 1202 as the second wheel 1102. Similarly, the wheels 1102 can have various thicknesses 1208. The thickness 1208 of the wheel 1102 can change the size of the rolling surface 1204. For example, a wheel 1102 with a larger thickness will have a larger rolling surface 1204.

Based on the disclosure and teachings provided herein, a person of ordinary skill in the art will appreciate other ways and/or methods to implement the various embodiments. The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims. For example, it should be noted that the supports may have additional shapes, such as a square or rectangular shape with four openings proximal to each of the four corners, a triangular shape with three openings each proximal to one of the corners thereof, and so on. In addition, the supports may be T-shaped, cross-shaped, C-shaped, and so forth, and may have openings proximal the ends thereof, and further may have one or more openings between the openings at the ends thereof.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Various embodiments of this disclosure are described herein, including the best mode known to the inventors for carrying out the disclosure. Variations of those embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A kit for assembling a modular toy structure, the kit comprising:

supports consisting essentially of:

two or more supports, each of the supports having first and second connection areas positioned at respective first and second ends, wherein at least one support of the two or more supports has a first circular portion at a first edge and a second circular portion at a second edge, and at least two supports of the two or more supports has a same length and width; and connectors consisting essentially of:

two or more connectors, each of the connectors having surface indentations and being configured to engage with the first or second connection areas to couple two or more of the supports, wherein a connector of the two or more connectors comprises a first end configured to engage with a plurality of connection areas.

2. The kit of claim 1, further comprising instructions having directions for assembling the two or more supports and the two or more connectors to form a modular toy structure.

3. The kit of claim 1, wherein the two or more set of supports and the two or connectors are adapted to build a car.

4. The kit of claim 1, wherein the first and second connection areas each define a circular opening having a first diameter and each of the connectors has a circular cross-section having a second diameter.

5. The kit of claim of claim 4, wherein the first diameter is larger than the second diameter.

6. The kit of claim of claim 1, wherein each of the connectors comprises a central portion and first and second ends, each of the first and second ends configured to engage with the first and second connection areas.

7. The kit of claim of claim 6, wherein the first and second ends each have a circular cross-section with a first diameter and the central portion has a circular cross-section with a second diameter.

8. The kit of claim of claim 7, wherein the first diameter is smaller than the second diameter.

9. The kit of claim of claim 1, wherein one or more connection areas of the plurality of connection areas is configured to rotate.

10. The kit of claim of claim 1, wherein a support of the supports comprises an identifying mark.

11. The kit of claim of claim 1, wherein a support of the supports comprises one or more of plastic, wood, carbon-fiber, metal, or 3-D printed material.

12. The kit of claim of claim 1, wherein a connector of the connectors comprises one or more of plastic, wood, carbon-fiber, metal, or 3-D printed material.

* * * * *